US007134847B2

(12) United States Patent
Nishihara et al.

(10) Patent No.: US 7,134,847 B2
(45) Date of Patent: Nov. 14, 2006

(54) HERMETIC ELECTRIC COMPRESSOR HAVING A SUCTION MUFFLER

(75) Inventors: Hidetoshi Nishihara, Kanagawa (JP); Yasushi Hayashi, Singapore (SG); Tomio Maruyama, Singapore (SG); Tsuyoshi Matsumoto, Kanagawa (JP); Ikutomo Umeoka, Kanagawa (JP); Akio Yagi, Kanagwa (JP)

(73) Assignee: Matsushita Refrigeration Company, Shiga (JP)

( * ) Notice: Subject to any disclaimer, the term of this patent is extended or adjusted under 35 U.S.C. 154(b) by 272 days.

(21) Appl. No.: 10/467,522

(22) PCT Filed: Apr. 26, 2002

(86) PCT No.: PCT/JP02/04294

§ 371 (c)(1),
(2), (4) Date: Dec. 18, 2003

(87) PCT Pub. No.: WO02/090774

PCT Pub. Date: Nov. 14, 2002

(65) Prior Publication Data

US 2004/0120832 A1 Jun. 24, 2004

(30) Foreign Application Priority Data

May 7, 2001 (JP) ..... 2001-136033

(51) Int. Cl.
*F04B 39/00* (2006.01)

(52) U.S. Cl. ..... 417/312; 417/403; 181/212

(58) Field of Classification Search ..... 417/312, 417/415, 902; 184/6.6
See application file for complete search history.

(56) References Cited

U.S. PATENT DOCUMENTS 4,569,639 A * 2/1986 Hannibal et al. ..... 417/368
5,201,640 A * 4/1993 Heinzelmann et al. ..... 417/312
5,228,843 A * 7/1993 Novolan et al. ..... 417/363
5,988,990 A * 11/1999 Lee ..... 417/312
6,524,080 B1 * 2/2003 Chintamani et al. ..... 417/312
2005/0207920 A1 * 9/2005 Ide et al. ..... 417/437

FOREIGN PATENT DOCUMENTS

| | | |
|---|---|---|
| GB | 2 315 523 | 2/1998 |
| JP | 52-9108 | 1/1977 |
| JP | 52-65910 | 5/1977 |
| JP | 52-139407 | 10/1977 |
| JP | 60-139085 | 9/1985 |

* cited by examiner

*Primary Examiner*—Anthony Stashick
*Assistant Examiner*—Vikansha Dwivedi
(74) *Attorney, Agent, or Firm*—Wenderoth, Lind & Ponack, L.L.P.

(57) ABSTRACT

The present invention provides an hermetic electric compressor capable of stably supplying oil to a compression chamber with a low noise level. The hermetic electric compressor has a closed vessel, an electric element, a compressing element that is disposed over the electric element and driven by the electric element, and an oil reservoir. The hermetic electric compressor also has an oil supply mechanism for supplying the oil from the oil reservoir to the compressing element in the closed vessel, and a suction muffler that communicates with a refrigerant suction part for sucking a refrigerant into the compressing element and is formed of a box body having a predetermined spatial volume. The suction muffler is positioned below the position where the oil is supplied into the closed vessel, and the box body has at least one oil suction port used for sucking a predetermined amount of oil.

19 Claims, 5 Drawing Sheets

FIG. 6 – PRIOR ART
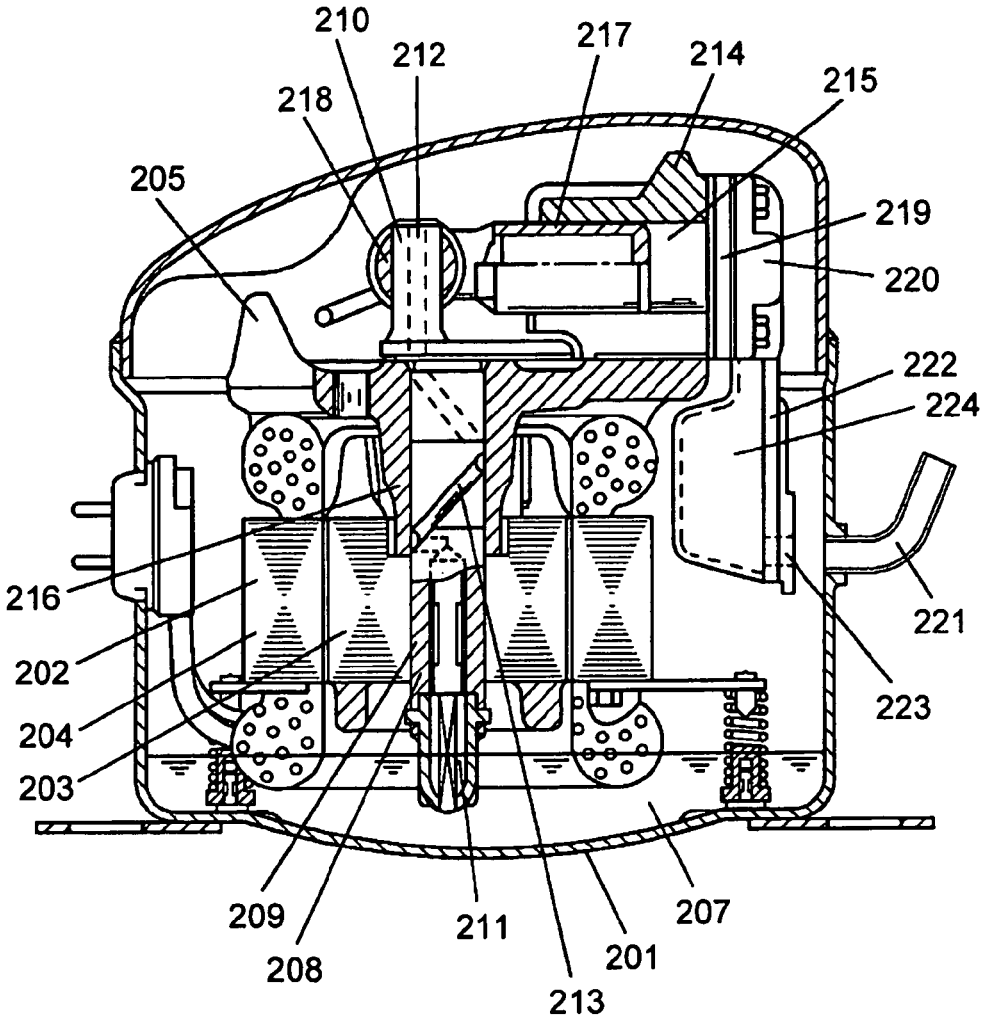

HERMETIC ELECTRIC COMPRESSOR HAVING A SUCTION MUFFLER

TECHNICAL FIELD

The present invention relates to an hermetic electric compressor used in an electric refrigerator, an air conditioner, or a vending machine.

BACKGROUND ART

An hermetic electric compressor including an electric element and a compressing element in a closed vessel is widely used as a compressor employed in an electric refrigerator or an air conditioner. For example, an hermetic electric compressor having a structure shown in FIG. 6 is disclosed as prior art in U.S. Pat. No. 5,228,843.

The conventional hermetic electric compressor will be described hereinafter with reference to FIG. 6. The upside and downside of the hermetic electric compressor are determined with reference to the state where the compressor is installed in the normal attitude.

FIG. 6 is a sectional view of the conventional hermetic electric compressor. Closed vessel 201 includes stator 202, electric element 204 formed of rotor 203, and compressing element 205 driven by electric element 204. Oil 207 is reserved in the lower part of closed vessel 201. Compressing element 205 will now be described in detail. Crankshaft 208 has spindle 209 pressed and fitted to rotor 203 and eccentric part 210 formed eccentrically to spindle 209. Oil pump 211 is disposed in spindle 209 so as to open in oil 207. One end of communication hole 212 disposed in eccentric part 210 opens at the upper end of eccentric part 210, and the other end communicates with oil pump 211 via oil groove 213 formed in the outer periphery of spindle 209. Cylinder block 214 has substantially cylindrical compression chamber 215 and bearing 216 for pivoting spindle 209, and is formed over electric element 204. Piston 217 is inserted into compression chamber 215, and is coupled to eccentric part 210 through coupling means 218. Valve plate 219 having a compressing valve and a suction valve is disposed on an end surface of compression chamber 215, and head 220 having a space partitioned to a discharge side and a suction side is disposed outside valve plate 219. Suction tube 221 is fixed to closed vessel 201 and connected to the low pressure side (not shown) of a freezing cycle so that refrigerant gas (not shown) is guided into closed vessel 201. Suction muffler 222 is disposed under cylinder block 214, and is grappled and hence fixed by valve plate 219 and head 220. One end of suction muffler 222 communicates with the suction side of head 220 and communicates with compression chamber 215 through the suction valve of valve plate 219. The other end of suction muffler 222 forms sound absorbing space 224 communicating with opening 223 formed near suction tube 221 disposed in closed vessel 201.

A series of operations in the structure discussed above are described. Rotor 203 of electric element 204 rotates crankshaft 208. Motion of eccentric part 210 is transmitted to piston 217 via coupling means 218, thereby reciprocating piston 217 in compression chamber 215. Refrigerant gas guided into closed vessel 201 through suction tube 221 is sucked from opening 223 of suction muffler 222, and is continuously compressed in compression chamber 215. By rotating crankshaft 208, oil 207 is sucked by oil pump 211, is guided upwardly from oil groove 213, passes through communication hole 212, and is sprayed from the upper end of eccentric part 210 into closed vessel 201. Sprayed oil 207 is sucked together with refrigerant gas from opening 223 of suction muffler 222, and provides lubrication and sealing between piston 217 and the inside of compression chamber 215.

However, the hermetic electric compressor has the following problems. In the conventional hermetic electric compressor, oil 207 sprayed into closed vessel 201 is indirectly sucked together with refrigerant gas from opening 223, so that an amount of oil 207 sucked into compression chamber 215 is widely dispersed by spraying oil 207. Therefore, when the amount of oil 207 is small, lubrication between piston 217 and the inside of compression chamber 215 is insufficient, thereby leading to the generation of abrasion of sliding parts, and sealing is incomplete thereby decreasing freezing capacity.

The present invention addresses the conventional problems, and aims to provide an hermetic electric compressor capable of stably supplying the right amount of oil into a compression chamber.

DISCLOSURE OF THE INVENTION

The present invention provides an hermetic electric compressor having the following structure. The hermetic electric compressor has a closed vessel connected at least to a suction refrigerant pipe and a discharge refrigerant pipe. The compressor also has, in the closed vessel, an electric element, a compressing element that is disposed over the electric element and driven by the electric element, and an oil reservoir for storing oil under the electric element. The compressor also has an oil supply mechanism and a suction muffler. The oil supply mechanism supplies the oil from the oil reservoir to the compressing element in the closed vessel. The suction muffler communicates with a refrigerant suction part for sucking a refrigerant into the compressing element and is formed of a box body having a predetermined spatial volume. The suction muffler is positioned below the position where the oil is supplied into the closed vessel, and the box body has at least one oil suction port used for sucking a predetermined amount of oil.

This structure allows the oil supplied to the compressing element in the closed vessel to be stably sucked through the oil suction port formed in the box body of the suction muffler. Therefore, the oil can be stably supplied into a compression chamber, thereby smoothening lubrication on a sliding part.

Additionally, at least the upper surface of the box body is positioned under the position where the oil is supplied into the closed vessel. The oil sprayed to the upper part of the box body can thus be received and collected by the upper part of the box body, and hence the collected oil can be stably sucked from the oil suction port to the compression chamber through the suction muffler.

The oil suction port is formed in a surface of the suction muffler inside the closed vessel, so that noise transmitted from the oil suction port can be reduced.

Additionally, a side surface of the box body is provided with a step part projecting outwardly, and the upper surface of the box body tilts by at least the installation angle or more of the hermetic electric compressor. The step part tilts downwardly, and toward the oil suction port, the tilting angle of the step part is at least the installation angle or more of the hermetic electric compressor. A communication groove for connecting the step part to the oil suction port is disposed.

Thanks to the structure, the oil supplied to compressing element in the closed vessel drops to the upper surface of the box body of the suction muffler, flows down on the upper surface, then flows down on the step part, and is stably sucked into the oil suction port through the communication groove. The oil supply to the compression chamber is further stabilized.

BRIEF DESCRIPTION OF THE DRAWINGS

FIG. 6 is a sectional view of a conventional hermetic electric compressor.

DETAILED DESCRIPTION OF THE PREFERRED EMBODIMENT

An exemplary embodiment of the present invention will be described hereinafter with reference to the drawings.

Figure 1:
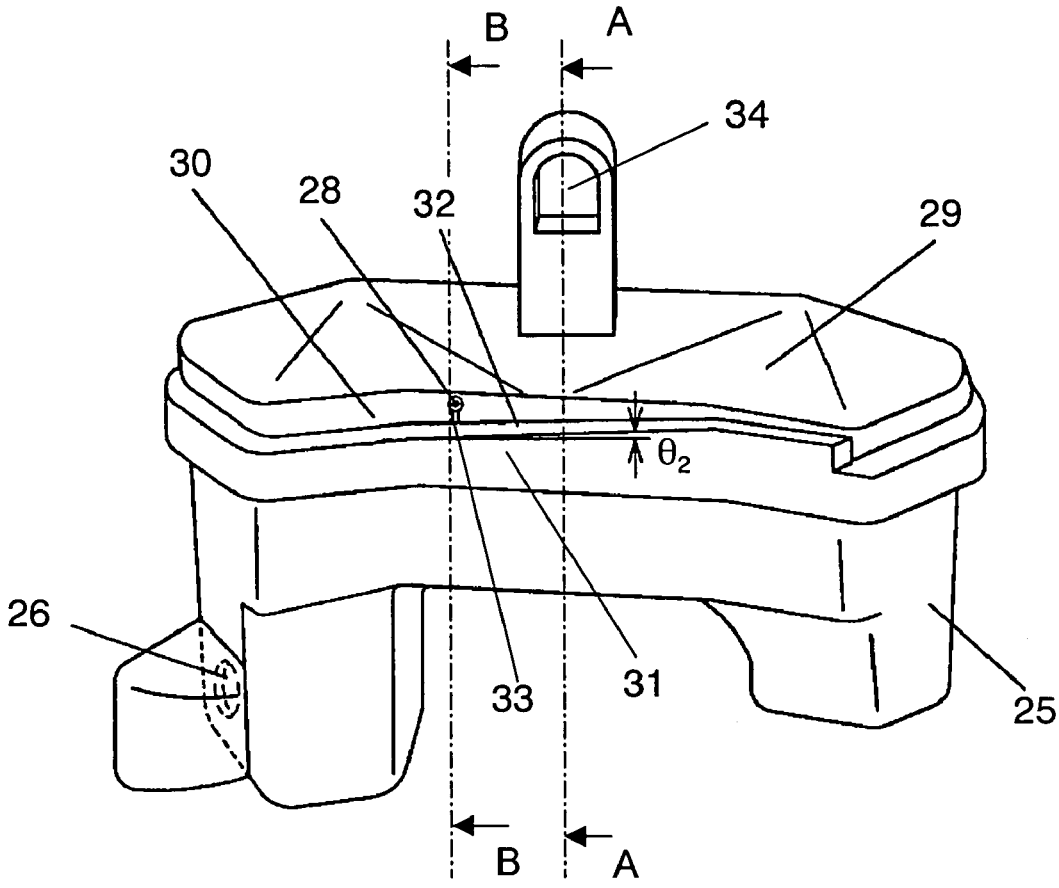
FIG. 1 is a perspective view of a suction muffler of an hermetic electric compressor in accordance with an exemplary embodiment of the present invention.
Figure 2:
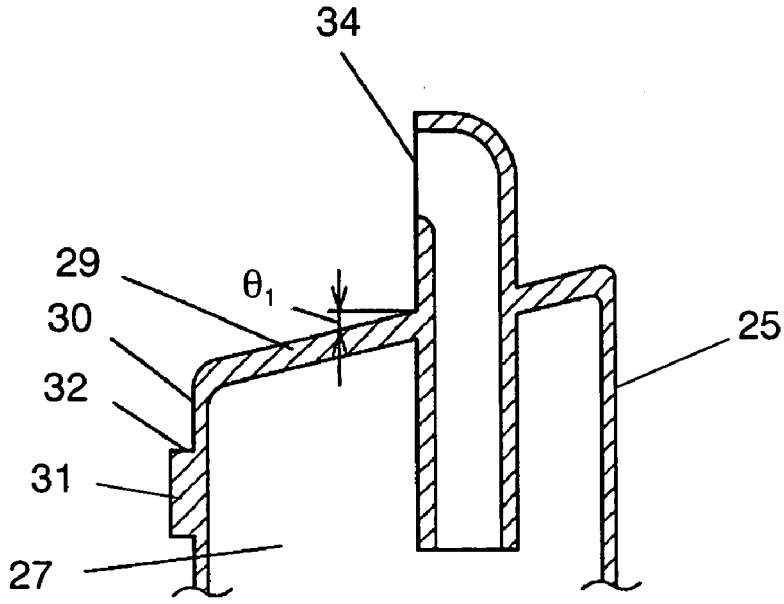
FIG. 2 is a sectional view taken along the line A—A of FIG. 1.
Figure 3:
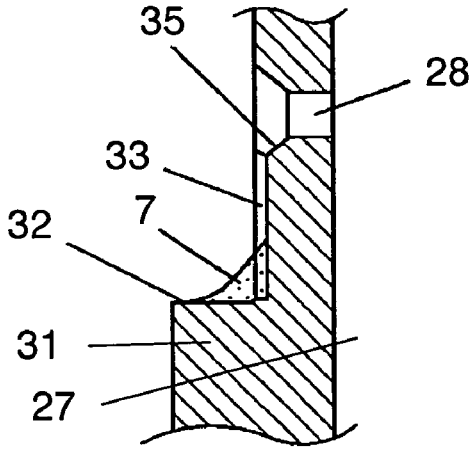
FIG. 3 is a sectional view taken along the line B—B of FIG. 1.
Figure 4:
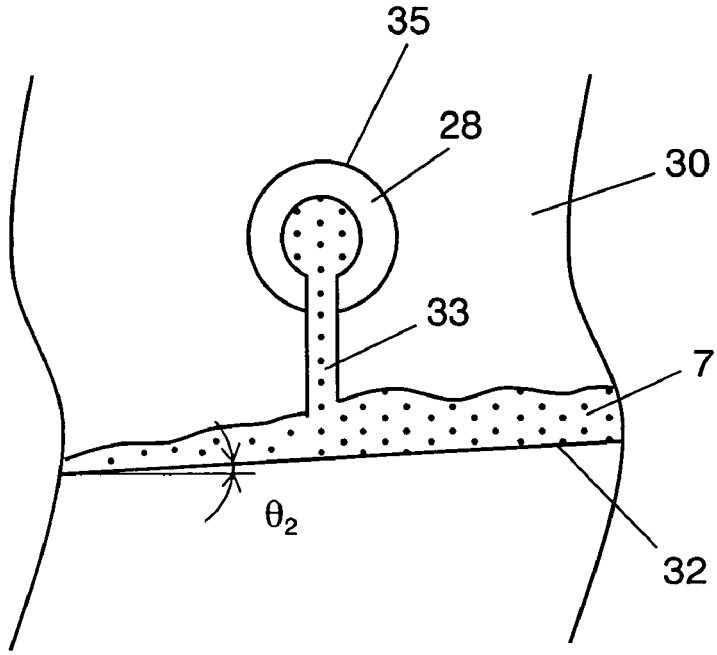
FIG. 4 is a front view of the suction muffler at the part shown in FIG. 3.
Figure 5:
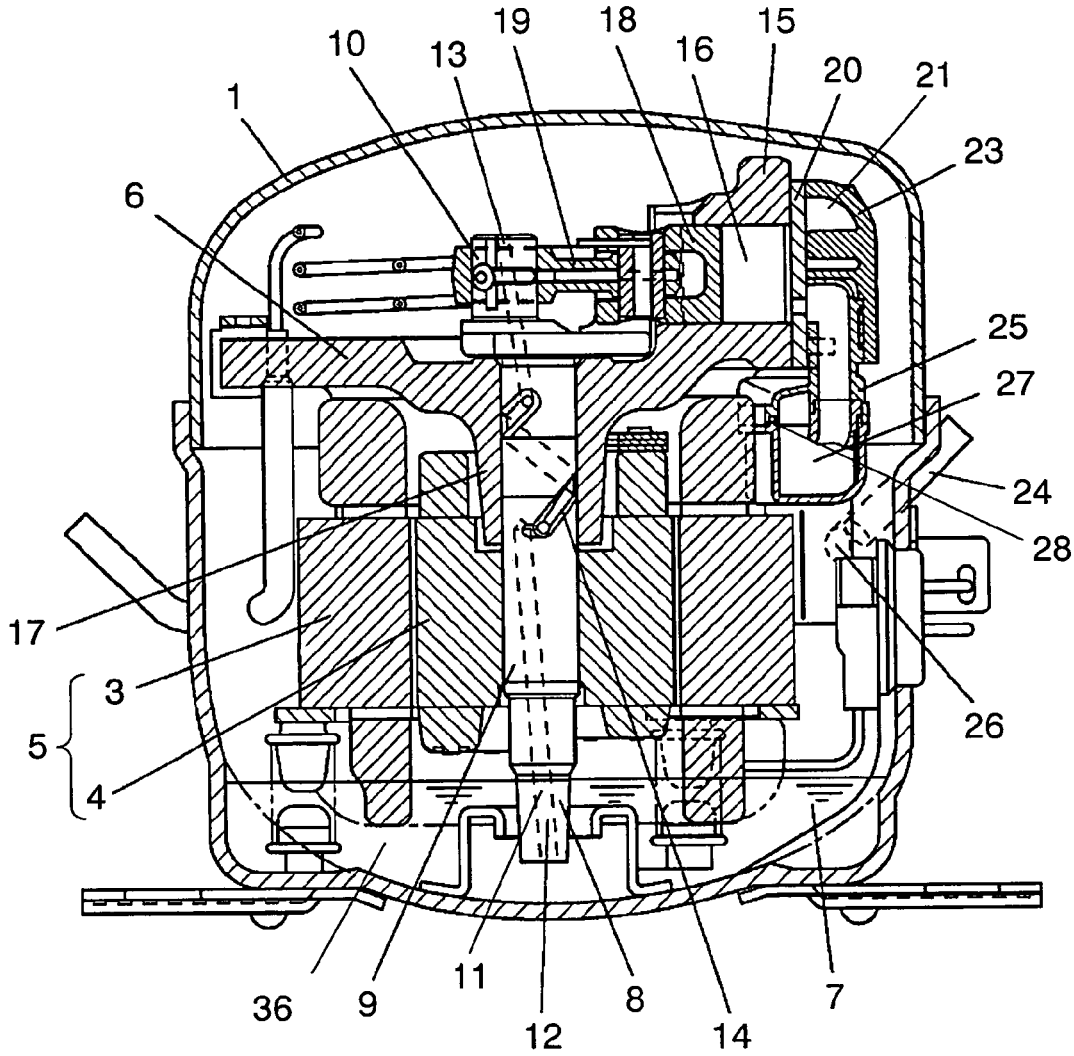
FIG. 5 is a sectional view of the hermetic electric compressor in accordance with the exemplary embodiment of the present invention.

FIG. 1 is a perspective view of a suction muffler of an hermetic electric compressor in accordance with the exemplary embodiment. FIG. 2 is a sectional view taken along the line A—A of FIG. 1. FIG. 3 is a sectional view taken along the line B—B of FIG. 1. FIG. 4 is a front view of the suction muffler at the part shown in FIG. 3. FIG. 5 is a sectional view of the hermetic electric compressor in accordance with the exemplary embodiment.

A structure of the hermetic electric compressor of the exemplary embodiment is described with reference to FIG. 5. Closed vessel 1 includes stator 3, electric element 5 formed of rotor 4, and compressing element 6 driven by electric element 5. Oil reservoir 36 is disposed in the lower part of closed vessel 1 and stores oil 7.

Compressing element 6 is described in detail. Crankshaft 8 has spindle 9 pressed and fitted to rotor 4 and eccentric part 10 formed eccentrically to spindle 9. Oil pump 12 formed of hole 11 having a tilt with respect to the shaft core of spindle 9 is disposed in spindle 9 so as to open in oil 7 in oil reservoir 36. Communication hole 13 is disposed in eccentric part 10. One end of communication hole 13 opens at the upper end of eccentric part 10, and the other end communicates with oil pump 12 via oil groove 14 formed in the outer periphery of spindle 9. Cylinder block 15 has substantially cylindrical compression chamber 16 and bearing 17 for pivoting spindle 9, and is formed over electric element 5. Piston 18 is inserted into compression chamber 16, and is coupled to eccentric part 10 through connecting rod 19 as a coupling means. Valve plate 20 seals an end surface of compression chamber 16, and has a discharge valve (not shown) and a suction valve (not shown). Head 23 having a high pressure chamber 21 communicating with the discharge valve is fixed on the opposite side to compression chamber 16 with respect to valve plate 20. Suction tube 24 is fixed to closed vessel 1 and connected to the low pressure side (not shown) of a freezing cycle so that refrigerant gas (not shown) is guided into closed vessel 1.

In FIG. 5, suction muffler 25 is disposed under cylinder block 15, and grappled and fixed by valve plate 20 and head 23. One end of suction muffler 25 communicates with compression chamber 16 via the suction valve of valve plate 20. The other end of suction muffler 25 forms sound absorbing space 27 communicating with opening 26 formed near suction tube 24 disposed in closed vessel 1.

FIG. 1 is a perspective view of the entire suction muffler 25, FIG. 2 is a sectional view taken along the line A—A of FIG. 1, and FIG. 3 is a sectional view taken along the line B—B of FIG. 1. Suction muffler 25 has a box body shape as a whole, and is made of engineering plastics such as polybutylene terephthalate (PBT). Oil suction port 28 for connecting the internal space service as sound absorbing space 27 of suction muffler 25 to the outside of suction muffler 25 is disposed in the side part of suction muffler 25. The outer surface of the side part having oil suction port 28 faces the inside of closed vessel 1. Upper surface part 29 of suction muffler 25 is thicker than the other surface parts forming suction muffler 25, and tilts by tilting angle $\theta_1$ toward side surface 30 having oil suction port 28. Tilting angle $\theta_1$ is set at an angle exceeding 5°. This 5° is an upper limit on the installation angle of a general hermetic electric compressor. The upper limit on the installation angle of the general hermetic electric compressor means an allowable angle between the compressor and the horizontal plane of the floor when a body of an electric refrigerator, an air conditioner, or a vending machine having the built-in the compressor is installed. Step part 31 is formed below oil suction port 28, and oil sump 32 is disposed on the upper surface of step part 31. Oil sump 32 has tilting angle $\theta_2$ on the surface of suction muffler 25 facing to the inside of the closed vessel, namely on surface 30 facing to the electric element side, and tilts toward oil suction port 28 by tilting angle $\theta_2$. Tilting angle $\theta_2$ exceeds 5° as the upper limit on the installation angle of the general hermetic electric compressor. Communication groove 33 having a substantially V-shaped cross section connects oil sump 32 to oil suction port 28. The depth of communication groove 33 is set at 0.15 mm, and the diameter of oil suction port 28 is set at 0.5 mm. Suction communication part 34 that opens in suction chamber of head 23 shown in FIG. 5 is disposed over suction muffler 25. Oil suction port 28 has a chamfer 35.

Operations of the hermetic electric compressor having the structure discussed above are hereinafter described. Rotor 4 of electric element 5 rotates crankshaft 9, and motion of eccentric part 10 is transmitted to piston 18 via connecting rod 19. Piston 18 reciprocates in compression chamber 16, and refrigerant gas guided into closed vessel 1 through suction tube 24 is thus sucked from opening 26 of suction muffler 25 and continuously compressed in compression chamber 16. By rotating crankshaft 8, a centrifugal force is exerted on oil 7 through hole 11 tilting with respect to the shaft core in oil pump 12. Oil 7 is then sucked from oil reservoir 36, guided upwardly from oil groove 14, and sprayed from the upper end of eccentric part 10 into closed vessel 1 through communication hole 13. Oil 7 is sprayed also to cylinder block 15, drops from cylinder block 15 onto the upper surface 29 of suction muffler 25, and drops to the bottom of closed vessel 1 on the surface of suction muffler 25. At this time, oil 7 flowing on surface 30 of suction muffler 25 on the electric element 5 side is sucked into sound absorbing space 27 through oil suction port 28, is sucked into compression chamber 16 through suction communication part 34, and provides lubrication and sealing between piston 18 and the inside of compression chamber 16.

In the present invention, as discussed above, upper surface 29 of suction muffler 25 tilts toward surface 30 on the electric element 5 side, and tilting angle $\theta_1$ is set at not less than 5°, namely the upper limit on the installation angle of the general hermetic electric compressor. Therefore, regardless of an installation attitude of the hermetic electric compressor, almost all of oil 7 dropping onto the upper surface 29 of suction muffler 25 flows to surface 30 having oil suction port 28 on the electric element 5 side. As shown in FIG. 4, a certain amount of oil 7 is stored in oil sump 32 disposed on step part 31 below oil suction port 28, and oil 7 flows to oil suction port 28 due to surface tension thereof and is sucked into sound absorbing space 27. At this time, since oil sump 32 also tilts toward oil suction port 28 by tilting angle $\theta_2$ exceeding 5° as the upper limit on the installation angle of the general hermetic electric compressor, oil 7 is stably stored under oil suction port 28 regardless of the installation attitude of the hermetic electric compressor. The amount of oil sucked into sound absorbing space 27 can be therefore kept substantially constant.

Flow rate of the oil sucked into sound absorbing space 27 can be increased by connecting oil sump 32 to oil suction port 28 through communication groove 33, so that the oil can be further certainly sucked.

Changing the depth of communication groove 33 and the diameter of oil suction port 28 can change flow resistance of the oil, so that the amount of the oil sucked into sound absorbing space 27 can be controlled. Since the depth of communication groove 33 is set at 0.15 mm and the diameter of oil suction port 28 is set at 0.5 mm, 15 $mm^3$ of oil is sucked per hour. When the suction rate is less than 3 $mm^3$/hour, abrasion of the sliding part can occur because of insufficient lubrication between piston 18, and the inside of compression chamber 16 and the freezing performance can decrease because of incomplete sealing.

When the suction rate exceeds 30 $mm^3$/hour, power consumption can increase because the sucked oil is compressed to increase compression work or because a large amount of oil is discharged to a freezing cycle to decrease heat exchange efficiency of the freezing cycle. Therefore, it is preferable to set the suction rate of oil in the range of 3 $mm^3$/hour to 30 $mm^3$/hour.

Oil 7 dropping onto the upper surface 29 of suction muffler 25 from cylinder block 15 is heated by compression heat of cylinder block 15, the heat then transfers on the surface of suction muffler 25 and heats the sucked refrigerant gas in sound absorbing space 27. It is known that heating the sucked refrigerant gas decreases volume efficiency of the compressor. However, in the present invention, suction muffler 25 is made of engineering plastics such as PBT having low thermal conductivity, thereby moderating heating of the sucked refrigerant gas by oil 7 heated by compression heat of cylinder block 15. Glass fiber is mixed to engineering plastics by about 15%, thereby increasing the heat resistance and mechanical strength. For further decreasing the heating of the sucked gas, a method of mixing no glass fiber into the plastics is used. At this time, the thermal conductivity can be further decreased by 30%.

Since the thickness of upper surface 29 of suction muffler 25 that directly receives oil 7 having especially high temperature is set larger than that of the other surfaces constituting suction muffler 25, heating of the sucked refrigerant gas in sound absorbing space 27 is further suppressed.

Noise in sound absorbing space 27 partially leaks from oil suction port 28 and is transmitted, but, in the present invention, noise transmission toward closed vessel 1 is suppressed and noise transmission to the outside through closed vessel 1 can be reduced. That is because the opening of oil suction port 28 is directed to surface 30 on the electric element 5 side, namely to the opposite side to the outside of closed vessel 1.

The operations by the structure discussed above produce the advantage regardless of kinds of refrigerant and oil used.

INDUSTRIAL APPLICABILITY

In the present invention, as discussed above, oil stored in the lower part of a closed vessel having a compressing element is sprayed and supplied into the closed vessel in response to rotation of an electric element. The oil is then dropped onto a suction muffler that is disposed in a refrigerant suction part of the compressing element and absorbs sounds, and is stably supplied to a compression chamber through an oil suction port disposed in the suction muffler. The oil suction port open toward the inside of the closed vessel, so that noise transmitted from the oil suction port can be reduced.

Therefore, an hermetic electric compressor can be realized where the oil is stably supplied to the compression chamber, lubrication of the sliding part of the compression chamber is smoothened, and a stable operation with a low noise level is allowed.

The invention claimed is:

1. A hermetic electric compressor comprising:

a closed vessel connected at least to a suction refrigerant pipe and a discharge refrigerant pipe;

an electric element disposed in said closed vessel;

a compressing element that is disposed over said electric element in said closed vessel and is driven by said electric element;

an oil reservoir for storing oil under said electric element in said closed vessel;

an oil supply mechanism for spraying and supplying the oil from said oil reservoir to an upper part of said compressing element in said closed vessel; and a suction muffler that communicates with a refrigerant suction part for sucking a refrigerant into said compressing element and is formed of a box body having a predetermined spatial volume, wherein said suction muffler is separated from said compressing element, made of a material having low thermal conductivity, and positioned below a position where the oil is sprayed and supplied into said closed vessel such that said box body forming said suction muffler is arranged so that oil sprayed and supplied to an upper part of said compressing element drops down to a surface of said box body, and said box body has at least one oil suction port arranged for sucking a predetermined amount of oil from the oil which drops down to said surface of said box body from the oil sprayed and supplied to said upper part of said compressing element.

2. A hermetic electric compressor according to claim 1, wherein the oil suction port is disposed in a surface of said suction muffler facing inwardly toward a center portion of an interior of said closed vessel.

3. A hermetic electric compressor according to claim 2, wherein an upper surface of the box body tilts downwardly toward the surface having the oil suction port;

wherein said oil suction port is arranged to suck oil thereinto to lubricate an inside of said compressing element.

4. A hermetic electric compressor according to claim 2, wherein an upper surface part of the box body of said suction muffler has a greater thickness than the other parts of said box body.

5. A hermetic electric compressor according to claim 1, wherein an upper surface of the box body tilts downwardly toward the surface having the oil suction port; and wherein said oil suction port is arranged to suck oil thereinto to lubricate an inside of said compressing element.

6. A hermetic electric compressor according to claim 5, wherein an upper surface of said box body has a tilting angle larger than a maximum installation angle for said hermetic electric compressor relative to horizontal.

7. A hermetic electric compressor according to claim 1, wherein a side surface of the box body has a step part projecting outwardly from the box body.

8. A hermetic electric compressor according to claim 7, wherein the step part tilts downwardly toward the oil suction port.

9. A hermetic electric compressor according to claim 8, wherein a step part has a tilting angle larger than a maximum installation angle for said hermetic electric compressor relative to horizontal.

10. A hermetic electric compressor according to claim 9, wherein a communication groove for connecting the step part to the oil suction port is provided.

11. A hermetic electric compressor according to claim 8, wherein a communication groove for connecting the step part to the oil suction port is provided.

12. A hermetic electric compressor according to claim 7, wherein a communication groove for connecting the step part to the oil suction port is provided.

13. A hermetic electric compressor according to claim 12, wherein an amount of oil flowing through the oil suction port and the communication groove is in a range of 3 $mm^3$/hour to 30 $mm^3$/hour.

14. A hermetic electric compressor according to claim 1, wherein said suction muffler is made of plastic material.

15. A hermetic electric compressor according to claim 14, wherein the plastic material contains no glass fiber.

16. A hermetic electric compressor according to claim 1, wherein an upper surface part of the box body of said suction muffler has a greater thickness than other parts of said box body.

17. A hermetic electric compressor according to claim 1, wherein said electric element comprises a stator on an outside of said electric element and a rotor on an inside of said electric element, said electric element comprises a main shaft inserted into and fixed to a rotation center of the rotor and an eccentric shaft that is connected to the main shaft, is eccentric from a shaft center of the main shaft, and is connected to the compressing element, said suction muffler is grappled and fixed by a valve plate and a head, one end of said suction muffler communicating with the compression chamber via a suction valve of the valve plate, the other end of said suction muffler communicating with the inside of said closed vessel via an opening, and said compressing element includes a piston connected to said eccentric shaft such that rotation of the eccentric shaft by the rotor is converted to a reciprocating motion of said piston, thereby compressing the refrigerant.

18. A hermetic electric compressor according to claim 17, wherein an oil passage tilting with respect to a shaft center of the main shaft is disposed at least in the main shaft.

19. A hermetic electric compressor according to claim 17, wherein said eccentric shaft is configured and arranged such that the oil stored in the oil reservoir is sprayed and supplied from the eccentric shaft into the closed vessel by rotation of said electric element.

* * * * *

UNITED STATES PATENT AND TRADEMARK OFFICE

CERTIFICATE OF CORRECTION

PATENT NO. : 7,134,847 B2
APPLICATION NO. : 10/467522
DATED : November 14, 2006
INVENTOR(S) : Hidetoshi Nishihara et al.

It is certified that error appears in the above-identified patent and that said Letters Patent is hereby corrected as shown below:

ON THE FRONT PAGE

In section (56) "References Cited", please add a subheading and a reference citation as follows:

--Other Patent Documents

Patent Abstracts of Japan, vol. 2000, no.13, February 5, 2001 (2/5/2001), & JP 2000

274359 A (Matsushita Refrig. Co., Ltd.), October 3, 2000 (10/3/2000)--.

Signed and Sealed this

Tenth Day of April, 2007

JON W. DUDAS
*Director of the United States Patent and Trademark Office*